US005348843A

United States Patent [19]

Beck et al.

[11] Patent Number: 5,348,843

[45] Date of Patent: Sep. 20, 1994

[54] METHOD FOR MAKING PORCELAIN TAGS AND SIGNS BY SELECTIVELY RADIATING A FRIT CONTAINING-EMULSION COATING APPLIED THERETO

[75] Inventors: Edward W. Beck, Ontario; Blair M. Brewster, Brooklyn Heights; Andrew M. Walker, Pittsford, all of N.Y.

[73] Assignee: Permar Systems, Inc., Wolcott, N.Y.

[21] Appl. No.: 898,011

[22] Filed: Jun. 12, 1992

[51] Int. Cl.[5] ..... G03C 1/492; G03C 11/00

[52] U.S. Cl. ..... 430/275; 359/530; 428/210; 430/198

[58] Field of Search ..... 359/530; 428/210; 430/275, 198

[56] References Cited

U.S. PATENT DOCUMENTS

| | | |
|---|---|---|
| 1,290,580 | 1/1919 | Kohler . |
| 1,938,291 | 12/1933 | Hurst et al. . |
| 2,021,819 | 11/1935 | Turk et al. . |
| 2,710,814 | 6/1955 | Mears . |
| 2,865,750 | 12/1958 | Trevoy . |
| 3,010,804 | 5/1974 | Rowland . |
| 3,684,348 | 8/1972 | Rowland . |
| 4,189,209 | 2/1980 | Heasley . |
| 4,327,283 | 4/1982 | Heyman et al. . |
| 4,349,598 | 9/1982 | White . |
| 4,355,093 | 10/1982 | Hartmann et al. . |
| 4,506,006 | 3/1985 | Ruckert . |
| 4,507,382 | 3/1985 | Rousseau et al. . |
| 4,514,456 | 4/1985 | Deal et al. . |
| 4,555,161 | 11/1985 | Rowland . |
| 4,588,258 | 5/1986 | Hoopman . |
| 4,632,900 | 12/1986 | Demmet et al. . |
| 4,732,794 | 3/1988 | Hyde . |
| 4,938,563 | 7/1990 | Nelson et al. . |
| 4,952,023 | 8/1990 | Bradshaw et al. . |
| 4,959,256 | 9/1990 | Piera . |

OTHER PUBLICATIONS

Applied Laser Technology, Inc., Scottsdale, Ariz. 85260: *Discover the Universal Laser System for Engraving and IndustriaL Applications* . . . .

Reflexite Corporation, New Britain, Conn.: *Reflexite Reflective Material-Product Bulletin.*

Inc./Jan. 1992: *E. O. Y. 1992, The Winners-Collective Effort.*

Price lists: *Clear Hard Molded Reflector Pricing Sheet.*

Safety Premium Lines ASI 84520: *Reflector Gifts Help Sales Light Up!*

Reflexite Corporation: *News, Fall 1987, vol. III, No. 3.*

Reflexite Corporation: *Retroreflective Elements.*

Reflexite Corporation: *News, Winter 1986, vol. II, No. 1.*

Reflexite Corporation: *News, Spring 1987, vol. III, No. 1.*

Reflexite Corporation: *Take a Look at at Brilliant Reason Why You Should Trim Your Coat with Reflexite!*

Reflexite Corporation: *News, Fall, 1986, vol. II, No. 2.*

(List continued on next page.)

*Primary Examiner*—John Kight, III

*Assistant Examiner*—T. Mosley

*Attorney, Agent, or Firm*—Cumpston & Shaw

[57] ABSTRACT

The invention is directed to an improved method for making a porcelain enamel tag or sign. The process involves forming a single white porcelain enamel base coat over a suitable metal backing, and firing to bond the porcelain enamel to the metal, resulting in the formation of a porcelain coated metal blank. The blank is then coated with a photographic emulsion which contains a colored frit. The emulsion coating is allowed to dry, and is then ready to receive a printed image. The desired image or graphic to be reproduced is formed on a light transmitting backing, which is made in the form of a print. The print is then affixed to the porcelain enamel blank which contains the emulsion overcoating. The blank containing the image on its surface is then exposed to a source of activating radiation. Following exposure, the image containing blank is developed in a warm aqueous solution, whereby the water serves to develop the emulsion mixture. The developed blank is then fired to burn off the emulsion mixture, whereby the colored frit in the form of the desired image melts and is fused into the base coat to form a permanent image.

23 Claims, No Drawings

OTHER PUBLICATIONS

Seibu Polymer Chemical Co., Ltd.: *Seibulite® Reflective Sheeting.*

3M: *How 3M Uses Retroreflectivity to Help Drivers See the Road at Night; The Brighter Way to Safer Roads.*

3M: *Preliminary Data Sheet, Jul. 15, 1988; Orientation Guidelines for "Scotchlite" Reflective Sheeting Diamond Grade Sries 3970G.*

3M: Preliminary Data Sheet, Jul. 15, 1988; Product Bulletin.

3M Traffic Control Materials Division: *Scotchlite Process Colors, Series 880.*

3M Traffic Control Materials Division: *The Versatile Alternative; Scotchlite Reflective Liquid From 3M.*

Porcelain Enamel Institute, Inc.: *Porcelain Enameling, From Metals Handbook Ninth Edition, vol. 5.*

Howard Prigosin: *Porcelain Enameling Stainless Steel and Copper.*

Tetko, Inc. Briarcliff Manor, New York: *Product Information News.*

Screen Printing Network, Mar. 1992: *The Complete Guide to Not-So-Basic Screen Making.*

Signs of the Times, Dec. 1990: *Porcelain Enamel: The Sign Industry's Most Durable Material.*

Nitto Denko Corporation, Tokyo 102, Japan: *Nitto Duratack H.*

Porcelain Enamel Institute, Inc., Arlington, Va.: *Properties of Porcelain Enamel; Data Bulletin PE1 503.*

Porcelain Enamel Institute, Inc., Arlington, Va.: *Properties of Porcelain Enamel; Data Bulletin PE1 501.*

Porcelain Enamel Institute, Inc., Arlington, Va.: *Properties of Porcelain Enamel; Data Bulletin PE1 504.*

Porcelain Enamel Institute, Inc., Arlington, Va.: *Properties of Porcelain Enamel; Data Bulletin PE1 505.*

Ciba-Geigy, Drakenfeld®: *Porcelain Enamel Oxide Colors; Price Schedule Jan. 1, 1992.*

Electromark, Wolcott, N.Y.: *Porcelain Signs.*

Electromark, Wolcott, N.Y.: *Phosphorescent Glow-in--the-Dark Signs.*

Electromark, Wolcott, N.Y.: *Electrocode Bar-Code Markers for Poles & Transformers.*

METHOD FOR MAKING PORCELAIN TAGS AND SIGNS BY SELECTIVELY RADIATING A FRIT CONTAINING-EMULSION COATING APPLIED THERETO

BACKGROUND OF THE INVENTION

Porcelain enamel coated products have existed and been used for over three centuries. Porcelain enamel may be defined as a substantially vitreous or glassy, inorganic coating bonded to metal by fusion at a temperature above 800° F. Although there have been many modifications to porcelain enamel technology over the years, the basic principles regarding the formation of porcelain coated products remain the same. Basically, a combination of metals and other organic compounds are combined in the form of a fine powder, like glass, into a frit. A frit may be defined as small friable particles produced by quenching a molten glassy material. The frit is then coated or applied, typically with a liquid carrier such as water, to the prepared surface of a blank or supporting substrate, such as a metal. The frit is then fired, usually at a temperature above 1,000° F., to form the desired porcelain enamel coating on the selected product. Porcelain enamel coated products typically include grills, stove tops, washing machines, plates, utensils, bath tubs, and tags and signs. Because of its outstanding weather, chemical and heat resistance, porcelain enamelling has undergone a recent resurgence in view of a cost aware economy and the need for certain products which exhibit durability over a long period of time.

With respect to outdoor use, porcelain enamel tags and signs offer the ultimate in durability. For this reason, porcelain enamel signs are commonly used for gas pipe lines and electric utility tower transmission signs, which are examples of two applications where it is extremely costly to install a sign and where the durability and extra life of the sign is extremely important. In addition, porcelain enamel signs can be easily cleaned after being defaced, and for this reason, provide an excellent product for use in public areas such as parks, subways, and zoos.

Typically, porcelain signs are currently made using a metal backing such as steel, in view of porcelain enamel's ability to bind to metal. Generally the metal is first pickled and washed in a variety of hot baths, in order to remove any oil or other unwanted material from the surface. If all the oil is not effectively removed from the surface, it will cause a blemish and the porcelain enamel will not adhere to that spot. After pickling the metal blank, it is typically coated with a grey ground coat of frit. This coating may conveniently take place by either dipping the blank in a wet solution of grey frit, or by spraying with a wet solution. The ground coat has been specially made to adhere well to the metal. The ground coat is then fired to form a porcelain enamel coating over the metal backing. The next step is to apply a white (or other solid background color) coating on top of the ground coat. This coating can be painted, sprayed, or dipped over the ground coat as described above in the forming of the ground coat. Following the application of the white coat, the sign blank is then fired again.

After this step, the sign blank is now ready to receive the desired graphics typically in the form of an image and/or words. The image is typically made by an art department by any suitable graphics program available to the art or hand typesetting technique. The image is eventually shot onto a film positive, and the film positive placed on to a previously photo-sensitized, stretched screen, and exposed. The screen now has the image burned into it, and the image appears as openings in the screen mesh; with the unprinted background having the opaque coating.

The finished screen is then positioned in a screen press, and porcelain enamel ink is loaded into the screen, and the white coated porcelain enamel blank sign is printed. The porcelain enamel ink is available from a number of frit manufacturers of powdered frits and oils. The oils help the frit flow and make the frit screen printable.

Once the words are printed on the sign, generally in black, the frit is allowed to air dry. During the drying process, the oil in the frit evaporates, and after the black words dry, the sign is then fired. After cooling, the sign is then completed.

The above process represents the current state of the art for making porcelain enamel signs and tags. This process, although suitable for a large run of signs or hags, is extremely expensive for making one-of-a-kind or small numbers of signs due to the labor intensive costs involved in the various steps. Therefore, there has been a continuing need in the field for an improved process, which would allow for porcelain enamel signs to be made more simply and efficiently.

SUMMARY OF THE INVENTION

The present invention is directed to an improved method for making a porcelain enamel tag or sign. The process involves forming a single white porcelain enamel base coat over a suitable metal backing, and firing to bond the porcelain enamel to the metal, resulting in the formation of a porcelain coated metal blank. The blank is then coated with a photographic emulsion which contains a colored frit. The emulsion coating is allowed to dry (if a wet process is used), and is then ready to receive a printed image. The emulsion coating is maintained under controlled light conditions to avoid premature activation. The desired image or graphic to be reproduced is formed on a light transmitting backing, which is made in the form of a print. The print is then affixed to the porcelain enamel blank which contains the emulsion overcoating. The blank containing the image on its surface is then exposed to a source of activating radiation. Following exposure, the image containing blank is developed in a warm aqueous solution, whereby the water serves to develop the emulsion mixture leaving the image on the blank in the form of the emulsion mixture, while washing away the remaining background emulsion mixture. The developed blank is then fired to burn off the emulsion mixture, whereby the colored frit in the form of the desired image melts and is fused into the base coat to form a permanent image.

DETAILED DESCRIPTION OF THE INVENTION

The present invention is directed to a new way of making porcelain enamel tags or signs. The invention provides the advantage of being able to use a single white porcelain enamel base coat over a metal backing, following by coating the blank with a photographic emulsion which contains a colored frit. A negative or positive of the desired image in the form of a print is affixed to the emulsion coated side of the blank, and the print is then exposed to activating light and then developed in a warm aqueous solution. This is followed by firing the blank to burn off the emulsion, resulting in the colored frit in the form of the image being melted into and fused to the base coat.

The present invention provides a novel way to use a photographic emulsion in combination with a powdered frit to make one-of-a-kind porcelain tags, at approximately half the cost of currently available prior art production techniques. The basic steps, process parameters, and materials using this process, are as follows:

Generally, the backing used in the present invention is preferably a metal such as steel, stainless steel, or possibly aluminum. Once selected, the metal is cut to the proper size, and either pickled and/or washed to clean the surface and remove all surface, debris and oils. A preferred technique in preparing the metal surface can employ the use of a sanding machine, which is used to put a matte or brushed surface on the metal. It has been found that the use of a very coarse grit sandpaper in a sanding machine provides a sufficiently rough surface, and scrapes off oils, which effectively bonds the base coat of porcelain enamel to the metal.

The frit may be applied by any conventional wet process known to the art. Alternatively, the coating may be applied to the metal backing by an electrostatic spray. The electrostatic spray, also known as the dry process, provides advantages in that it is environmentally safer and provides better coverage along the edges and is economically advantageous over dip coating process.

The porcelain enamel coating is generally formed by being fired for about one to three minutes in a temperature range of about 1,350° to 1,500° F. The time and temperature may vary outside this range, depending upon the materials used.

A critical aspect of the present invention is with respect to the use of the photographic emulsion containing the colored frit. The emulsions which can be used in the present invention can be any standard commercially available photographic emulsion. Suitable emulsions are available from Kissel & Wolf under the Kiwocol trademark; from Autotype under the Autosol Plus, Autosol Fast trademarks; from Murakami under the Aqualsol-TS, MSP2, and One Pot Sol trademarks; and from Ulano under the 569, TXL, and 925 trademarks. Both water or solvent based systems may be used. The systems (emulsions) referred to above are "negative" emulsions, but "positive" emulsions are available commercially, and can be used. A "positive" emulsion would allow the user to go directly from a positive film and avoid having to make the negative contact print.

Any suitable amount of frit can be used in the emulsion. A concentration of from about 10–40% frit by volume to 60% to 90% by volume of the emulsion has been found to be satisfactory. A typical concentration which works satisfactorily is about 30% frit to 70% emulsion by volume. The frit is typically a conventional mixture of inorganic compounds, and does not change the sensitivity or function of the emulsion. Suitable frits which can be used include those disclosed in Tables 1 and 2 on page 510 of the publication *Porcelain Enameling* by the ASM Committee on Porcelain Enameling, pages 509–531 (1982), which is incorporated herein by reference. A suitable commercially available frit is sold by Ciby-Geigy under the trade name 8091 Black Frit. One requirement of the frit is that it contains a colored component, usually in the form of an oxide or mixture of oxides. Suitable oxides include those contained in the Ciba-Geigy price schedule dated Jan. 1, 1992, entitled Porcelain Enamel Oxide Colors, which is incorporated herein by reference. Typical oxide colors include 1795 Black (Co-Fe-Cr); 9020 Red Brown (Cr-Fe-Zn); and 9025 Blue (Co-Cr-Al).

The emulsion mixture is then coated on to the porcelain coated metal blank. The emulsion mixture is allowed to dry and forms a black or dark coating over the white ceramic layer. The coating step may be carried out by any suitable technique known to the art. Preferably, the coating is done with an airbrush, a wet mechanical coater, by dipping, screen printing, or brushing the part.

The print which is used to apply the graphics to the sign may be formed by any technique known in the art. In one embodiment a print is formed onto a transparency or translucent vellum paper stock. The print should be a negative, unless a reverse photo emulsion is used, in which case the print should be a positive. The print containing the image is then taped temporarily to the previously emulsion coated porcelain enamel blank. The blank with the reverse or negative image is then exposed for an appropriate amount of time, (i.e. 20 seconds, with a mercury light or other bright light source to suitably activate the emulsion). The blank is then developed after first removing the image containing film or vellum from the surface of the blank. The blank is then washed in warm water, which serves to develop or remove the emulsion mixture in the non-image or background area.

The blank can then be dried (optionally) or be put in directly into an oven to be fired. During the firing process, the original photographic emulsion components of the emulsion mixture contained in the image area are burned off, and the frit remains in the form of the desired image. The high temperature melts the frit and the black or dark frit becomes fused to the base coat.

The following is one example of a step-by-step process sequence for making a porcelain enamel tag or sign according to the present invention:

1. Blank Cut. A 4'×8' sheet of 0.030" thick type 304 stainless steel is cut into 3" strips. The strips are then fed into a punch press that cuts out blanks having rounded corners and an overall dimension of 3"×5".

2. Blank Sanded. The 3"×5" blanks are ground on one side with a belt sander using a course grit paper to put a rough finish on the part, giving it a brushed look. Excess metal dust is then blown off.

3. Blank Acid washed. Optionally, to provide increased adhesion of the white coat, the part is rinsed in a light acid bath. A suitable bath contains 6–8% sulfuric acid and 92–94% water. The parts are washed off using gloves and a brush and left to air dry. The acid etch promotes adhesion and may be needed if the stainless steel is especially dirty.

4. Frit. The frit which forms a white coating after firing may be any commercially available frit. Suitable frits are available from Chi Vit Corporation or Ferro Corporation under the trade names of 145322R Frit and RM 60B, respectively. These frits can be purchased preground to the desired particle size and used directly in the process of the invention. The frit is mixed in the appropriate amount of water when using a wet process, to form a slip as is well known in the art. A suitable ratio of frit to water is about 1,000 grams of frit in 400–600 ml. of water. Other suitable frits and coating techniques are disclosed on pages 509–531 of the *Porcelain Enameling* publication, and in U.S. Pat. No. 4,732,794, both of which are incorporated herein by reference. If the purchased frit is coarse it can then be ground in the 2 gallon lab mill from Process Equipment. The ball mill is filled with two sizes of ceramic media (one is ⅜" o.d. and the other is ½" o.d.) and water. The balls occupy about 40% of the volume, the frit about 20% and water 20%. The remaining 20% is typically made up of conventional various mill additions (4%) and air 16%. These additions can be shifted to achieve various flow characteristics and alkali or acid resistance. The mixture is ground for about 5 hours. The resulting product is much finer than the original and should have about a 1–2% retention on a 200 mesh screen.

5. Part Coated. Once the frit is made or selected, the stainless steel blank is coated with the frit slurry by dipping it in a pan containing the frit slip or slurry. The blank is covered with the white frit, and the excess frit drips off of the park back into the pan.

6. Part Fired. The part is then fired in a furnace for about two to three minutes at 1,400° F. As the part is removed from the furnace, it is allowed to air cool.

7. Color Coding. Optionally, there may be some color-coding placed on the blank. For example, a colored border is typically placed on the blank that designates that the park goes to a particular system in a nuclear plant. The borders are screen printed on an SA press. The screens are made, inks mixed and press set up in the typical manner known to the ark. A Ciba-Geigy Series 8000 ink that is already prepared as a screen paste may be used. The paste (or ink) uses pine oil as its carrier (that allows the ink to flow through the screen evenly under pressure from the squeegee.

8. Part Fired. After the border is screen printed, the part is put back into the oven (see step 6 above). At this point, the part is typically fired using a lower temperature and faster speed (1,200° F. for only about 90 seconds). Although the part is not completely fired, later, when the one-of-a-kind image is added with the photo-frit steps, the park will be more fully fired. Excessive refiring of a part can slightly change the border color or background color or can even start to cause the part to chip.

9. Frit Blended with Emulsion. The frit/emulsion mixture is made by blending the appropriate concentration of colored frit with the emulsion to form the desired photo-frit mixture. The photo-frit mixture is made in a black polyethylene container and stored in a light-free area, 10. Frit Blend is Spayed onto Park. The photo-frit mixture is put into a glass bottle under an airbrush, The mixture is then applied by spraying to a batch of 20 tags made by steps 1–8 above. Excess overspray is vacuumed out of the area, The spraying is done manually and takes about 30 seconds for a batch of 20 tags. The photo-frit mixture can also be applied with a roller coater, brush, dip or screen print.

11. Frit Coated Part is Dried. The photo-frit mixture is then allowed to dry on the part. It is important that the part can be completely dry in that moisture may escape during the next firing step (see Step 16) and cause the frit to appear fuzzy and cause slight cracking in the fired black portions of the tag, Drying takes about 15 minutes in an oven controlled at 100° F.

12. One-of-a-Kind Art Printed on Laser Printer. A film image is made of a selected one-of-a-kind legend to be reproduced on the tag. The legend is printed on a high resolution laser printer that can produce up to 1,200 dpi. One variation of this process is to send reverse film (i.e. Agfa) through the laser printer itself. The toner is attached to the film, the film is exposed with a bright light and developed. The toner is then washed out and removed, and the image appears in reverse, Another suitable method is to print the image on a white paper and make a contact print of it using a negative film. Crop marks are applied to the film that will be used to line up the legend with the metal part.

13. Part with Frit Coating is Exposed. The image is placed on top of each metal part. About 20 parts are usually made at the same time. A vacuum table having a glass bottom is brought down over the parts which are laid face down over the glass. Air is drawn out from underneath a rubber blanket which covers the top of the table, and the table is tilted vertically and ready for exposure. A 5 KW metal halide light is then turned on and the image is exposed. The light is about 4 feet from the parts and exposure is for about 70 seconds.

14. Part is Developed. The parts are removed from the vacuum table and put into a stationary holding rack. Warm water (68° F.) is gently sprayed onto the parts. The image slowly appears. Areas surrounding the legend wash away. The exposure light causes the diazo to react with the PVA of the emulsion. The PVA in these portions becomes cross-linked. During the development process, water will dissolve the unexposed areas of the emulsion/photo-frit mixture and wash away these undissolved particles. Generally, the part should be washed out within 120 minutes of exposure with the light (see step 13 above).

15. Part is Dried. After the part is exposed, the part is dried. Drying is critical (see explanation under Step 11). Moisture may cause the black frit in the one-of-a-kind legend to crack when subjected to the high heat of the furnace (see next step). The part is dried in an oven for about 30 minutes at 100° F.

16. Part is Fired. The part is then fired again at 1,350° F. for about 2.5 minutes, resulting in the melting of the frit remaining in the image areas which is fused to the base coat to form a permanent image.

In a further embodiment of the present invention, it may be desirable to apply the one-of-a-kind image directly to the base metal, thereby avoiding the intermediate step of coating the blank with a grey coat and or white base coat. The blank Still should be cleaned with a sander and/or an acid wash. Firing the blank printed in this manner yields an oxidized darkened coating on the areas of the blank that are not covered with the one-of-a-kind image. This oxidation, however, can be cleaned off with many common solvents, such as acetone. Alternatively, the black oxided coating can be kept on the tag and the legend be printed directly using a contrasting white frit. Basically, this embodiment involves the numbered process steps previously referred to, except that steps 4–8 can be eliminated.

The above process is suitable for making signs of various types and also for signs or tags involving very detailed work, which requires fine resolution. For example, photographs or high density bar codes can be successfully depicted using the technique of the present invention. The present invention is also ideal for use in making one-of-a-kind tags, in that the costs involved are significantly reduced over the state of the art methods currently available.

Although particular embodiments of the present invention have been disclosed herein for purposes of explanation, further modifications or variations thereof will be apparent to those skilled in the art, to which this invention pertains.

What is claimed is:

1. A method of making a porcelain enamel coated sign which consists essentially of:
   (a) providing a metal backing having at least one clean surface;
   (b) applying a solid colored background base coating containing a frit to the clean surface of said backing, followed by firing for a time and temperature sufficient to form a porcelain enamel coated metal blank;
   (c) coating the porcelain surface of the blank formed by step (b) with a photographic emulsion which contains a colored frit and allowing the emulsion mixture to dry;
   (d) affixing a print or film containing the desired image to the porcelain enamel coated surface of said blank;
   (e) exposing the blank containing the image to a source of activating radiation;
   (f) developing the exposed blank in a warm aqueous solution whereby the water serves to develop the emulsion mixture; and
   (g) firing said blank to burn off the remaining emulsion mixture whereby the colored frit in the form of the desired image melts and is fused to the base coat.

2. The method of claim 1 in which a matte or brushed surface is formed on at least one side of said backing to receive the base coat.

3. The method of claim 1 in which the white base coat is formed by a dry process using an electrostatic spray.

4. The method of claim 1 in which the initial firing in step (b) is in the range of about 1350° to 1500° for about one to three minutes.

5. The method of claim 1 in which the amount of frit in the emulsion is from about 10% to 40% by volume.

6. The method of claim 5 in which the ratio of the frit to emulsion by volume is about 30% to 70%.

7. The method of claim 1 in which the image is formed on a transparency or translucent paper stock.

8. The method of claim 1 in which the print is in the form of a reverse or negative image.

9. The method of claim 1 in which the print is in the form of a positive image.

10. The method of claim 1 in which the film or paper is removed after the blank is exposed and the blank is then washed with warm water.

11. A method of making a porcelain enamel coated sign which consists essentially of:
   (a) providing a metal backing having at least one clean and roughened surface;
   (b) applying a solid colored background base coating to the roughened surface by a wet process, followed by firing to bond the porcelain enamel to the metal forming a porcelain coated metal blank;
   (c) coating the porcelain surface of the blank formed by step (b) with a photographic emulsion which contains a colored frit and allowing the emulsion mixture to dry;
   (d) affixing a print or film containing the desired image to the porcelain enamel coated surface of said blank;
   (e) exposing the blank containing the image to a source of activating radiation;
   (f) developing the image containing blank in a warm aqueous solution whereby the water serves to develop the emulsion mixture; and
   (g) firing said blank to burn off the remaining emulsion mixture whereby the colored frit in the form of the desired image melts and is fused to the base coat.

12. The method of claim 11 in which a matte or brushed surface is formed on at least one side of said backing.

13. The method claim 11 in which a dry process is used to form the coating in step (b).

14. The method of claim 11 in which the initial firing is in the range of about 1350° to 1500° for about one to five minutes.

15. The method of claim 11 in which the amount of frit in the emulsion is from about 10% to 40% by volume.

16. The method of claim 15 in which the ratio of the frit to emulsion by volume is about 30% to 70%.

17. The method of claim 11 in which the image is formed on a transparency or translucent paper stock.

18. The method of claim 11 in which the print is in the form of a reverse or negative image.

19. The method of claim 11 in which the print is in the form of a positive step.

20. The method of claim 11 in which the film or paper is removed after the blank is exposed and the blank is then washed with warm water.

21. A method of making a porcelain enamel coated sign which consists essentially of:
   (a) providing a metal backing having at least one clean surface;
   (b) coating the blank formed by step (a) with a photographic emulsion which contains a colored frit and allowing the emulsion mixture to dry;
   (c) affixing a print or film containing the desired image to the emulsion coated surface of said blank;
   (d) exposing the blank containing the image to a source of activating radiation;
   (e) developing the exposed blank in a warm aqueous solution whereby the water serves to develop the emulsion mixture; and
   (f) firing said blank to burn off the remaining emulsion mixture whereby the colored frit in the form of the desired image melts and is fused to the metal backing.

22. The product formed by the method of claim 1.

23. The product formed by the method of claim 21.

* * * * *